US009966173B2

(12) United States Patent
Oka

(10) Patent No.: US 9,966,173 B2
(45) Date of Patent: May 8, 2018

(54) SUPERCONDUCTING MAGNET DEVICE

(71) Applicant: JAPAN SUPERCONDUCTOR TECHNOLOGY INC., Kobe-shi (JP)

(72) Inventor: Atsuko Oka, Kobe (JP)

(73) Assignee: JAPAN SEMICONDUCTOR TECHNOLOGY INC., Kobe-shi (JP)

( * ) Notice: Subject to any disclaimer, the term of this patent is extended or adjusted under 35 U.S.C. 154(b) by 0 days. days.

(21) Appl. No.: 15/466,999

(22) Filed: Mar. 23, 2017

(65) Prior Publication Data

US 2017/0287608 A1 Oct. 5, 2017

(30) Foreign Application Priority Data

Mar. 30, 2016 (JP) ..... 2016-068310

(51) Int. Cl.

| | |
|---|---|
| ***H01F 6/00*** | (2006.01) |
| ***H01F 6/06*** | (2006.01) |
| ***H01F 27/02*** | (2006.01) |
| ***H01F 27/29*** | (2006.01) |
| ***H01F 27/28*** | (2006.01) |

(52) U.S. Cl.

CPC ..... *H01F 6/06* (2013.01); *H01F 27/02* (2013.01); *H01F 27/2885* (2013.01); *H01F 27/29* (2013.01)

(58) Field of Classification Search

CPC ... H01F 6/06; H01F 6/04; H01F 27/02; H01F 27/2885; H01F 27/29; G01R 33/3854; G01R 33/3815; G01R 33/20; G01V 3/00

USPC ..... 335/216

See application file for complete search history.

(56) References Cited

U.S. PATENT DOCUMENTS 4,943,781 A * 7/1990 Wilson ..... H05H 13/00 313/62
5,083,105 A * 1/1992 Herd ..... G01R 33/3815 174/15.4
5,113,165 A * 5/1992 Ackermann ..... H01F 6/04 335/216
5,613,367 A * 3/1997 Chen ..... G01R 33/3815 62/295
5,623,240 A * 4/1997 Sakuraba ..... H01F 6/065 174/15.4
5,918,470 A * 7/1999 Xu ..... F25D 19/006 335/216

(Continued)

FOREIGN PATENT DOCUMENTS

JP 2013-74082 4/2013

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

A superconducting magnet device includes a superconducting coil, a radiation shield, a vacuum case, an electrode member, and a conductive member. The conductive member includes an oxidized lead disposed in the radiation shield. The vacuum case includes a case body having an outer opening and an outer lid that is detachably attachable to the case body. The radiation shield includes a shield body having an inner opening and an inner lid that is detachably attachable to the shield body. The inner opening is formed in the region of the shield body that overlaps a portion of the outer opening when viewed in the direction from the outer opening to the oxidized lead.

2 Claims, 6 Drawing Sheets

(56) References Cited

U.S. PATENT DOCUMENTS 5,936,499 A * 8/1999 Eckels ..... G01R 33/3804 335/216
6,038,867 A * 3/2000 Einziger ..... G01R 33/3815 505/892
6,107,905 A * 8/2000 Itoh ..... F17C 3/085 335/216
7,295,010 B2 * 11/2007 Fukuda ..... G01R 33/3403 324/318
7,383,688 B2 * 6/2008 van Hassett ..... H03K 17/92 165/104.21
7,509,815 B2 * 3/2009 van Hassett ..... H01L 39/20 335/216
7,982,566 B2 * 7/2011 Kasten ..... G01R 33/3815 324/318
8,255,023 B2 * 8/2012 Schlenga ..... H01F 6/06 324/318
8,988,176 B2 * 3/2015 Aoki ..... G01R 33/3815 324/318
2004/0239462 A1 * 12/2004 Nemoto ..... H01F 6/065 335/216
2006/0125477 A1 * 6/2006 Killoran ..... G01R 33/28 324/321
2007/0089432 A1 * 4/2007 Boesel ..... F25D 19/006 62/51.1
2007/0210795 A1 * 9/2007 Motoshiromizu . G01R 33/3802 324/318
2008/0290869 A1 * 11/2008 Hutton ..... G01R 33/30 324/318
2010/0313574 A1 * 12/2010 Koyanagi ..... F25D 19/006 62/3.1
2011/0130293 A1 * 6/2011 Kawashima ..... H01F 6/04 505/163
2011/0210729 A1 * 9/2011 Iwasa ..... G01R 33/3802 324/307
2012/0081117 A1 * 4/2012 Jiang ..... F25D 19/00 324/318
2012/0094840 A1 * 4/2012 Tanaka ..... H01F 6/006 505/211
2012/0176134 A1 * 7/2012 Jiang ..... G01R 33/3804 324/318
2012/0184444 A1 * 7/2012 Blumenthal ..... G01R 33/3854 505/162
2012/0202697 A1 * 8/2012 Calvert ..... G01R 33/3858 505/163
2014/0085021 A1 * 3/2014 Blakes ..... H01F 6/04 335/216
2014/0097920 A1 * 4/2014 Goldie ..... H01F 6/00 335/216
2014/0274724 A1 * 9/2014 Inoue ..... H01F 6/065 505/163
2016/0369946 A1 * 12/2016 Tago ..... H01F 6/04
2017/0287606 A1 * 10/2017 Miyata ..... H01F 6/04

* cited by examiner

SUPERCONDUCTING MAGNET DEVICE

TECHNICAL FIELD

The present invention relates to a superconducting magnet device.

BACKGROUND ART

A superconducting magnet device that generates a high magnetic field using a superconducting coil in a superconducting state has conventionally been known. For example, JP 2013-74082 A discloses a superconducting magnet device including a superconducting coil, a radiation shield housing the superconducting coil, a vacuum case housing the radiation shield, an electrode pin connected to the vacuum case, a conductive member (e.g., a copper wire) for connecting the superconducting coil to the electrode pin, and a refrigeration unit connected to the vacuum case to refrigerate the superconducting coil. The conductive member includes an oxidized lead disposed inside the radiation shield. The oxidized lead is a conductor capable of conducting electricity from the electrode pin to the superconducting coil while minimizing heat transfer into the superconducting coil from the outside. The oxidized lead is connected to the superconducting coil and the electrode pin via conductive wires.

In the superconducting magnet device as disclosed in JP 2013-74082 A, the oxidized lead might burn out due to such a cause as a current flow in the insufficiently cooled oxidized lead. If such a burn out occurs, the oxidized lead needs to be replaced, and the replacement is very complicated. Specifically, to expose the oxidized lead to the outside, at least the vacuum case needs to be cut and the refrigeration unit and the radiation shield need to be removed. Then, after replacing the oxidized lead, the radiation shield should be reconnected, the refrigeration unit be reassembled, and the vacuum case be reconnected. As can be understood, replacement of the oxidized lead is very complicated and difficult to do at a site where the superconducting magnet device is installed. Therefore, the superconducting magnet device is transported from the site to a factory (where the replacement of the oxidized lead can be done), and then the replacement of the oxidized lead is done in the factory.

This means that if the oxidized lead burns out, a long downtime of the superconducting magnet device is required since the superconducting magnet device should be transported from the site to the factory to replace the oxidized lead in the factory, and then the superconducting magnet device should be sent back to the site. Moreover, if peripheral apparatuses are installed around the superconducting magnet device, the peripheral apparatuses should be disassembled and re-installed, which further extends the downtime of the device.

SUMMARY OF INVENTION

An object of the present invention is to provide a superconducting magnet device that enables easy replacement of an oxidized lead.

A superconducting magnet device according to an aspect of the present invention includes a superconducting coil, a radiation shield housing the superconducting coil, a vacuum case housing the radiation shield, an electrode member provided to the vacuum case, and a conductive member connecting the electrode member to the superconducting coil, wherein the conductive member includes an oxidized lead disposed inside the radiation shield, the vacuum case includes a case body having an outer opening shaped to permit insertion of the oxidized lead, and an outer lid shaped to close the outer opening and being detachably attachable to the case body, the radiation shield includes a shield body having an inner opening shaped to permit insertion of the oxidized lead, and an inner lid shaped to close the inner opening and being detachably attachable to the shield body, and the inner opening is formed in the region of the shield body that overlaps at least a portion of the outer opening when viewed in a direction from the outer opening to the oxidized lead.

DESCRIPTION OF EMBODIMENTS

A superconducting magnet device according to an embodiment of the present invention will now be described with reference to FIGS. 1 to 6.

Figure 1:
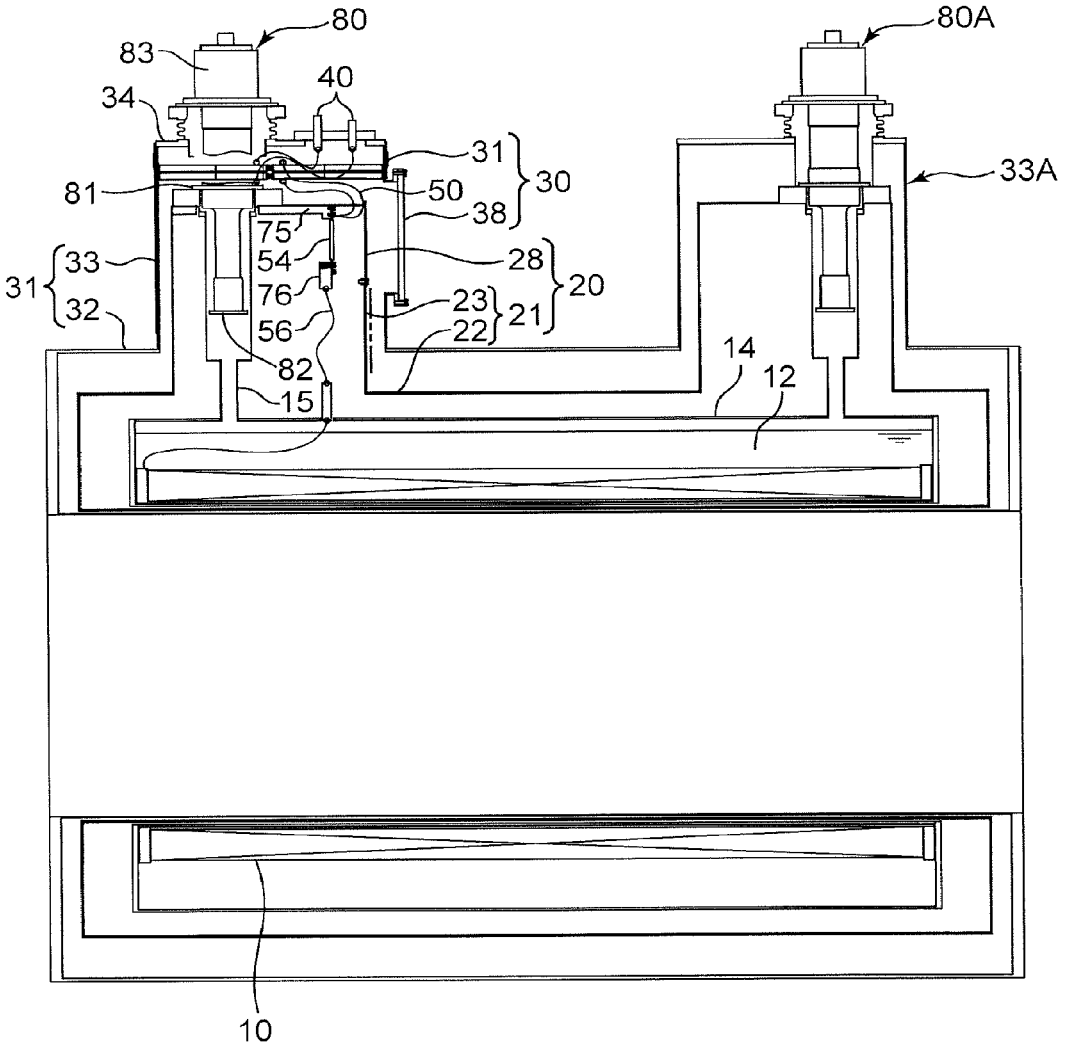
FIG. 1 is a sectional view schematically illustrating a superconducting magnet device according to an embodiment of the present invention.

As illustrated in FIG. 1, the superconducting magnet device includes a superconducting coil 10, a helium tank 14, a radiation shield 20, a vacuum case 30, an electrode member 40, a conductive member 50, and a refrigeration unit 80.

The superconducting coil 10 is formed by winding a wire made of a superconductor (superconducting material) around a frame.

The helium tank 14 houses the superconducting coil 10 and stores liquid helium 12. The helium tank 14 is made of stainless steel. As illustrated in FIG. 1, the helium tank 14 houses the superconducting coil 10 with the central axis of the superconducting coil 10 kept horizontal. A sleeve part 15 surrounding a portion of the refrigeration unit 80 is joined to the helium tank 14. Helium gas vaporized from the liquid helium 12 in the helium tank 14 is cooled by the refrigeration unit 80 in the sleeve part 15 and condenses. The condensed liquid helium 12 drops into the helium tank 14.

The radiation shield 20 is shaped to cover the helium tank 14 and the sleeve part 15. The radiation shield 20 is made of aluminum. The radiation shield 20 minimizes heat transfer into the helium tank 14 from the outside of the radiation shield 20. The radiation shield 20 includes a shield body 21 and the inner lid 28.

The shield body 21 includes an inner body 22 housing the helium tank 14, and an inner sleeve 23 that is joined to the inner body 22 and surrounds the sleeve part 15.

The inner sleeve 23 is joined to the inner body 22 with the axial direction of the inner sleeve 23 perpendicular to the axial direction of the inner body 22. An inner top wall 24 (see FIG. 2) is joined to the upper end of the inner sleeve 23. The inner sleeve 23 has an inner opening 21*a* that penetrates the inner sleeve 23 in the thickness direction. The inner opening 21*a* is provided on the upper portion of the inner sleeve 23.

The inner lid 28 is shaped to close the inner opening 21*a*. The inner lid 28 is detachably attachable to the inner sleeve 23 of the shield body 21. Specifically, the inner lid 28 is detachably attached to the inner sleeve 23 by fasteners 71. Screws are used as the fasteners 71 in the embodiment. When the fasteners 71 are removed, the inner lid 28 can slide in the up-and-down direction (in the axial direction of the inner sleeve 23) relative to the inner sleeve 23.

The vacuum case 30 is shaped to cover the radiation shield 20. The inside of the vacuum case 30 is kept in a vacuum condition. This minimizes heat transfer into the vacuum case 30. The vacuum case 30 includes a case body 31 and an outer lid 38.

The case body 31 includes an outer body 32 housing the helium tank 14 and the inner body 22, and an outer sleeve 33 that is joined to the outer body 32 and surrounds the inner sleeve 23.

The outer body 32 includes an inner circumferential wall and an outer circumferential wall each having a cylindrical shape. The superconducting coil 10, the helium tank 14, and the inner body 22 of the radiation shield 20 are housed in a space between the inner circumferential wall and the outer circumferential wall. The outer body 32 is made of stainless steel.

The outer sleeve 33 is joined to the outer body 32 and surrounds a portion of the refrigeration unit 80 and the inner sleeve 23. The outer sleeve 33 of the embodiment has a cylindrical shape. An outer top wall 34 is joined to the top end of the outer sleeve 33, and the electrode member 40 and the refrigeration unit 80 are connected to the outer top wall 34.

Figure 2:
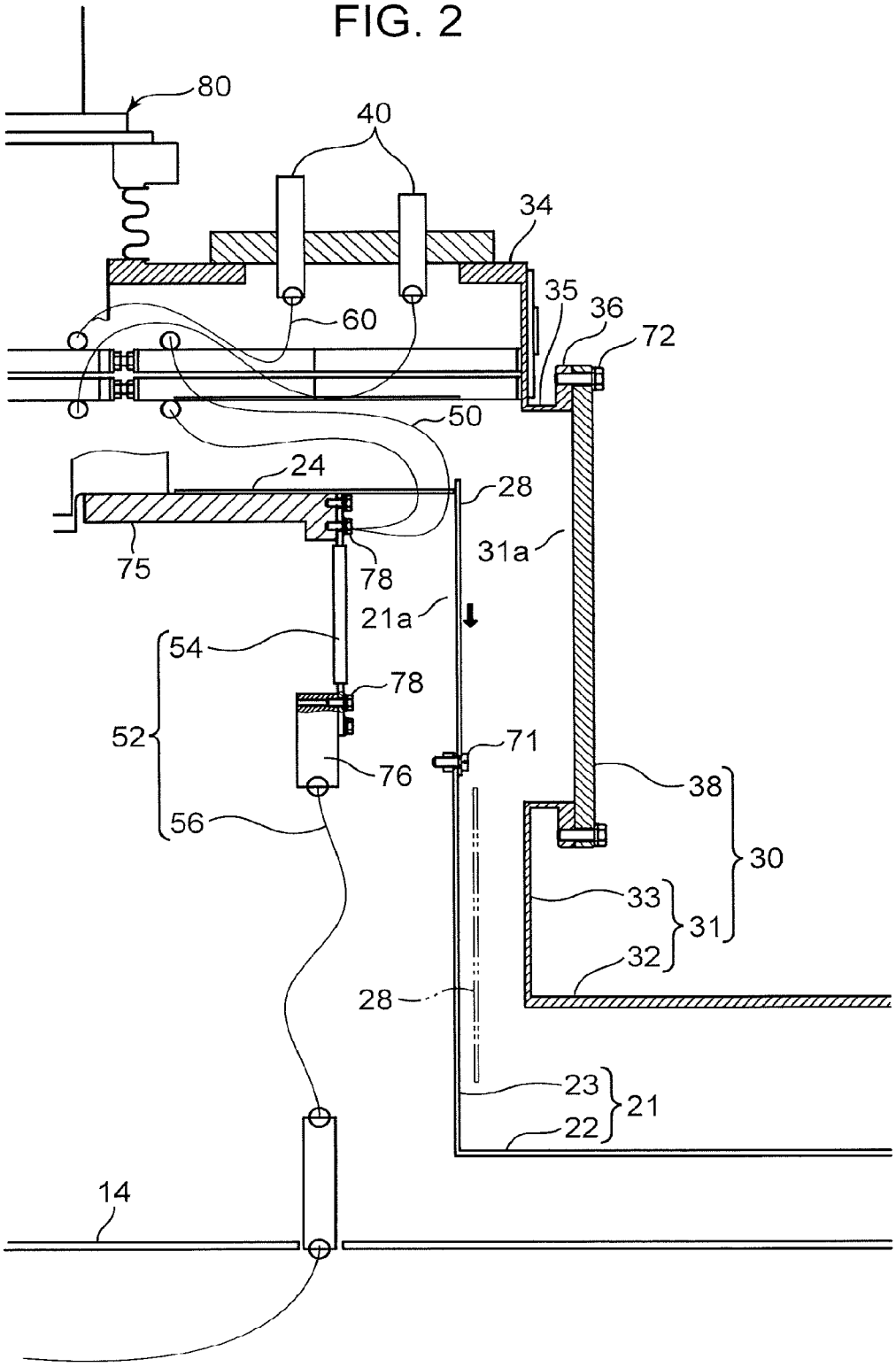
FIG. 2 is an enlarged view illustrating a region around an oxidized lead illustrated in FIG. 1.
Figure 3:
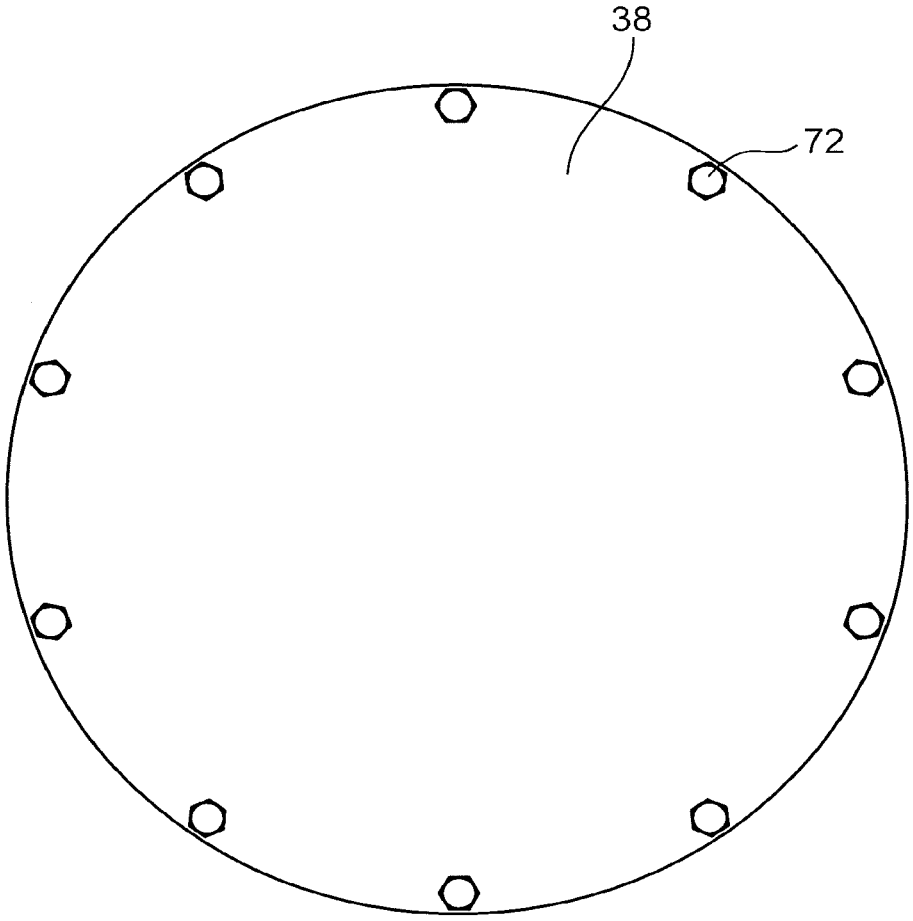
FIG. 3 is a side view of an outer lid in an attached state.
Figure 6:
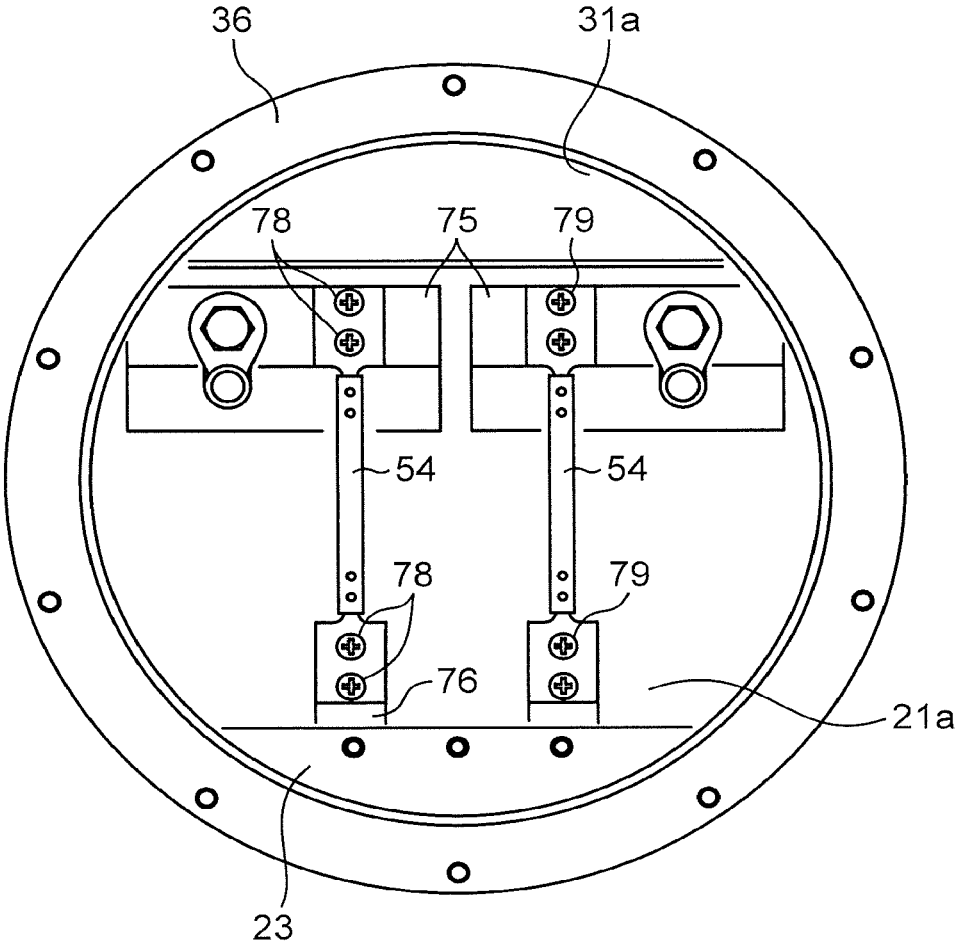
FIG. 6 illustrates a state where the inner lid is removed.

The outer sleeve 33 has an outer opening 31*a* that penetrates the outer sleeve 33 in the thickness direction. As illustrated in FIG. 2, a joint sleeve 35 is joined to the outer side face of the outer sleeve 33 to encircle the outer opening 31*a*. The joint sleeve 35 is joined to the outer sleeve 33 with the central axis of the joint sleeve 35 perpendicular to the central axis of the outer sleeve 33. The joint sleeve 35 of the embodiment has a cylindrical shape. A flange 36 is joined to the end of the joint sleeve 35 to swell outward in the radial direction of the joint sleeve 35. As illustrated in FIG. 6, the outer opening 31*a* and the inner opening 21*a* partially overlap each other in a side view (when viewed in the axial direction of the joint sleeve 35 from the outside of the vacuum case 30 to the inside of the vacuum case 30). More specifically, the dimension of the outer opening 31*a* in the up-and-down direction is larger than the dimension of the inner opening 21*a* in the up-and-down direction, and the dimension of the outer opening 31*a* in the right and left direction (the right and left direction in FIG. 6) is smaller than the dimension of the inner opening 21*a* in the right and left direction. The outer opening 31*a* is formed in a portion of the outer sleeve 33 that a portion of the inner opening 21*a*, a portion of the inner lid 28, and the fasteners 71 are inside the outer opening 31*a* in the side view. Each of the openings 21*a* and 31*a* has such a size that both hands can be inserted through the opening.

The outer lid 38 is shaped to close the outer opening 31*a*. The outer lid 38 is detachably attachable to the flange 36 of the case body 31. Specifically, the outer lid 38 is detachably attached to the flange 36 by fasteners 72. Bolts are used as the fasteners 72 in the embodiment.

The refrigeration unit 80 can detachably be connected to the vacuum case 30 (the outer top wall 35 of the embodiment). The refrigeration unit 80 includes a first cooling stage 81 and a second cooling stage 82. The first cooling stage 81 is connected to the radiation shield 20.

The second cooling stage 82 is disposed inside the sleeve part 15 extending upward from the helium tank 14. By driving a driving unit 83 of the refrigeration unit 80, the temperature of the first cooling stage 81 becomes 30 K to 60 K and the temperature of the second cooling stage 82 becomes about 4 K. In the embodiment, by driving the driving unit 83, the radiation shield 20 is cooled to a temperature of about 40 K to 90 K, and the helium gas evaporated from the liquid helium 12 in the helium tank 14 is cooled by the second cooling stage 82 and condenses.

In the embodiment, another outer sleeve 33A is joined to the case body 31 and another refrigeration unit 80A is connected to a top wall attached to the outer sleeve 33A. The refrigeration unit 80A is configured almost as the same as the refrigeration unit 80, and thus the description is omitted.

The conductive member 50 connects the superconducting coil 10 to the electrode member 40. Specifically, the conductive member 50 includes a low temperature conductor 52 disposed inside the radiation shield 20 and a high temperature conductor 60 disposed outside the radiation shield 20.

The low temperature conductor 52 includes an oxidized lead 54. The oxidized lead 54 is a conductor capable of conducting electricity from the electrode member 40 to the superconducting coil 10 while minimizing heat transfer into the superconducting coil 10 from the outside. An end of the oxidized lead 54 is connected to a member having a temperature of the same level as the first cooling stage 81 inside the radiation shield 20. In the embodiment, an end of the oxidized lead 54 is connected to a first fixed table 75 fixed to the bottom face of the inner top wall 24. The other end of the oxidized lead 54 is connected to a second fixed table 76 disposed below the first fixed table 75. The oxidized lead 54 is fastened to each of the fixed tables 75 and 76 by fasteners 78 that are detachably fastenable to the fixed tables 75 and 76. The fastener 78 has a manipulate-portion 79 that is manipulated using a tool that can be inserted through the openings 21*a* and 31*a*. Screws are used as the fasteners 78 in the embodiment. An end of the oxidized lead 54 is connected to the electrode member 40 via the high temperature conductor 60, and the other end of the oxidized lead 54 is connected to the superconducting coil 10 via a copper wire 56.

Figure 5:
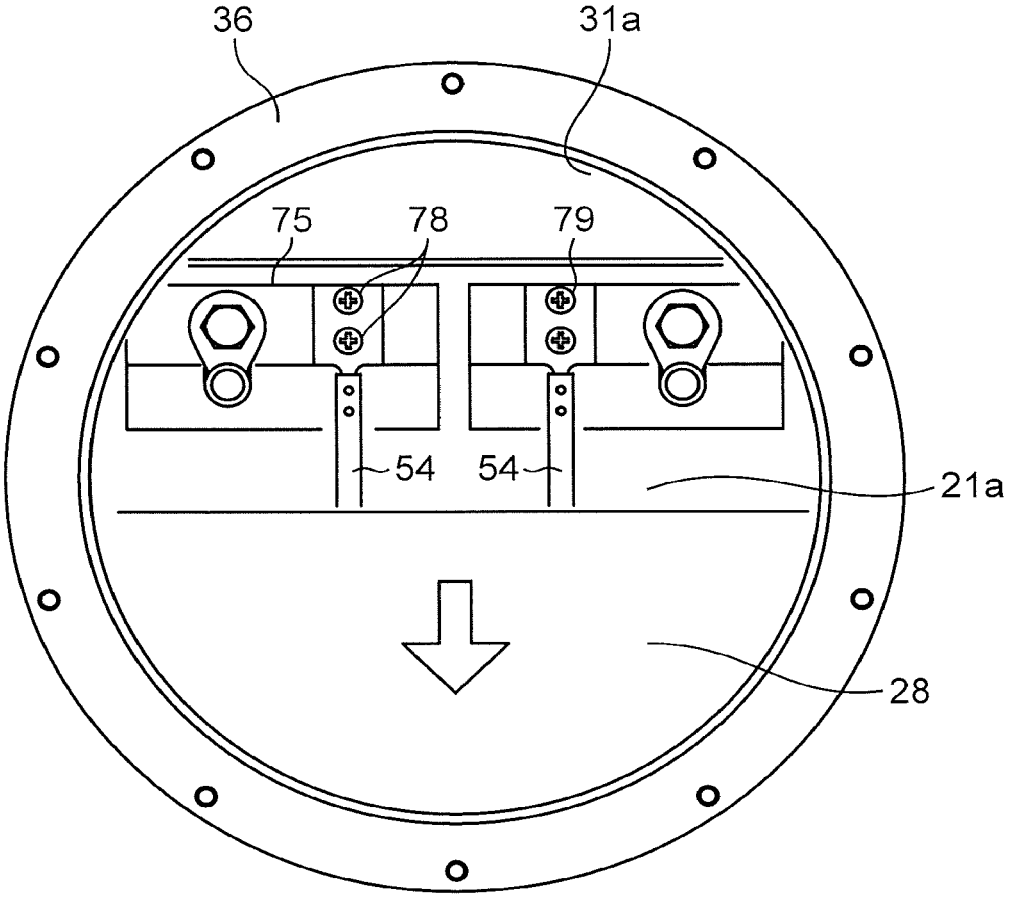
FIG. 5 illustrates a state where an inner lid is halfway removed.

As illustrated in FIGS. 5 and 6, the oxidized lead 54 and the fasteners 78 are located such that the oxidized lead 54 and the fasteners 78 are inside the inner opening 21*a* in the side view. In other words, the inner opening 21*a* is formed in the region of the inner sleeve 23 of the shield body 21 that overlaps the outer opening 31*a* when viewed in the direction from the outer opening 31*a* to the oxidized lead 54. Each of the fasteners 78 can be fastened to the fixed tables 75 and 76 with the manipulate-portion (head) 79 of the fastener 78 facing the inner opening 21*a* and the outer opening 31*a* (with the manipulate-portion 79 parallel to the direction from the inner opening 21*a* to the outer opening 31*a*). The openings 21*a* and 31*a* each has such a size that the oxidized lead 54 can be inserted through the opening.

Now, how to replace the oxidized lead 54 will be described.

Figure 4:
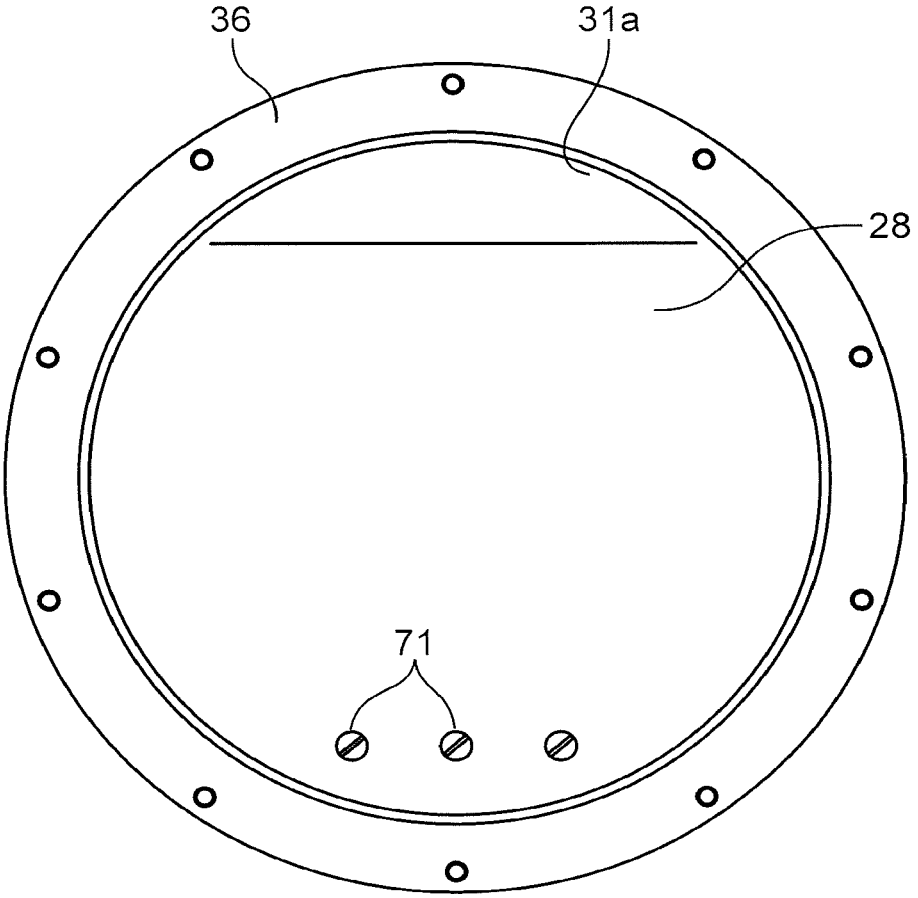
FIG. 4 illustrates a state where the outer lid is removed.

First, the fasteners 72 fastening the outer lid 38 to the flange 36 are removed to take off the outer lid 38. Accordingly, the inner lid 28 and the fasteners 71 can be viewed through the outer opening 31*a* as illustrated in FIG. 4, and a worker can access the fasteners 71 through the outer opening 31*a*.

Subsequently, the fasteners 71 fastening the inner lid 28 to the inner sleeve 23 are removed using a tool. Then, as illustrated in FIGS. 5 and 6, the inner lid 28 is slidably moved downward (in the direction shown by the arrow in FIGS. 2 and 5). Accordingly, the oxidized lead 54 and the fasteners 78 can be viewed through the outer opening 31*a* and the inner opening 21*a*, and the worker can access the oxidized lead 54 and the fasteners 78 through the outer opening 31*a* and the inner opening 21*a*.

Then, the oxidized lead 54 is removed from the fixed tables 75 and 76 by manipulating (turning), using a tool, the manipulate-portion 79 of the fastener 78 fastening the oxidized lead 54 to the fixed tables 75 and 76. The subsequent procedure is the reverse of the procedure described above. That is, a new oxidized lead 54 inserted through the outer opening 31*a* and the inner opening 21*a* is fastened to the fixed tables 75 and 76 with the fasteners 78, and then the inner lid 28 is slidably moved upward and fastened to the inner sleeve 23 with the fasteners 71. The outer lid 38 is fastened to the flange 36 with the fastener 72.

In the embodiment as described above, the case body 31 has the outer opening 31*a*, and the inner opening 21*a* is formed in the region of the shield body 21 that overlaps the outer opening 31*a* when viewed in the direction from the outer opening 31*a* to the oxidized lead 54. When the outer lid 38 is removed from the case body 31 and then the inner lid 28 is removed from the shield body 21 through the outer opening 31*a*, a worker can access the oxidized lead 54 through the outer opening 31*a* and the inner opening 21*a* from outside the vacuum case 30. The oxidized lead 54 can thus be replaced easily. The replacement can be performed at a site where the superconducting magnet device is installed, so that there is no need of transporting the superconducting magnet device between the site and the factory and operations such as cutting the vacuum case 30 and the radiation shield 20. Therefore, the downtime of the device can significantly be shortened.

Since the fasteners 78 are fastened to the fixed tables 75 and 76 with the manipulate-portion 79 of each fastener 78 facing the outer opening 31*a* and the inner opening 21*a*, the manipulate-portion 79 can be manipulated using a tool through the outer opening 31*a* and the inner opening 21*a* from the front side of the manipulate-portion 79. Thus, the oxidized lead 54 can easily be replaced.

It should be construed that the embodiment is disclosed above by way of illustration, not by way of limitation. The scope of the present invention is described by the claims, not by the embodiment. Any modification made within the meaning and the scope of the doctrine of equivalents all falls within the scope of the present invention.

For example, the liquid helium 12 and the helium tank 14 may be omitted. In such a case, the superconducting coil 10 is cooled by the refrigeration unit 80 via a plate joined to the second cooling stage 82 of the refrigeration unit 80.

The dimension of the inner opening 21*a* in the right and left direction (the right and left direction in FIG. 6) in the side view may be smaller than the dimension of the outer opening 31*a* in the right and left direction.

If a heat insulating layer is provided between the radiation shield 20 and the vacuum case 30, it is preferable to configure the portion of the heat insulating layer overlapping the outer opening 31*a* and the inner opening 21*a* in the side view to be openable.

The embodiment described above includes the following invention.

A superconducting magnet device according to the embodiment includes a superconducting coil, a radiation shield housing the superconducting coil, a vacuum case housing the radiation shield, an electrode member provided to the vacuum case, and a conductive member connecting the electrode member to the superconducting coil, wherein the conductive member includes an oxidized lead disposed inside the radiation shield, the vacuum case includes a case body having an outer opening shaped to permit insertion of the oxidized lead, and an outer lid shaped to close the outer opening and being detachably attachable to the case body, the radiation shield includes a shield body having an inner opening shaped to permit insertion of the oxidized lead, and an inner lid shaped to close the inner opening and being detachably attachable to the shield body, and the inner opening is formed in the region of the shield body that overlaps at least a portion of the outer opening when viewed in a direction from the outer opening to the oxidized lead.

In the superconducting magnet device, the case body has the outer opening, and the inner opening is formed in the region of the shield body that overlaps at least a portion of the outer opening when viewed in the direction from the outer opening to the oxidized lead. When the outer lid is removed from the case body and then the inner lid is removed from the shield body through the outer opening, the oxidized lead is accessible through the outer opening and the inner opening from outside the vacuum case. Accordingly, the oxidized lead can easily be replaced. Therefore, the replacement can be performed at a site where the superconducting magnet device is installed, so that there is no need of transporting the superconducting magnet device between the site and the factory and operations such as cutting the vacuum case and the radiation shield. Therefore, the downtime of the device can significantly be shortened.

In such a case, it is preferable that the device further includes a fixed table that is provided in the radiation shield to fix the oxidized lead, and a fastener that is detachably fastenable to the fixed table and configured to fasten the oxidized lead to the fixed table, and that the fastener includes a manipulate-portion that is manipulated using a tool that is insertable through the outer opening and the inner opening, and the fastener is fastenable to the fixed table with the manipulate-portion facing the outer opening and the inner opening.

Configured in such a manner, the oxidized lead can be replaced by manipulating the manipulate-portion using a tool inserted through the outer opening and the inner opening from the front side of the manipulate-portion. This makes replacement of the oxidized lead easier.

This application is based on Japanese Patent application No. 2016-068310 filed in Japan Patent Office on Mar. 30, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A superconducting magnet device comprising:

a superconducting coil;

a radiation shield housing the superconducting coil;

a vacuum case housing the radiation shield;

an electrode member provided to the vacuum case; and a conductive member connecting the electrode member to the superconducting coil, wherein the conductive member includes an oxidized lead disposed inside the radiation shield, the vacuum case includes a case body having an outer opening shaped to permit insertion of the oxidized lead, and an outer lid shaped to close the outer opening and being detachably attachable to the case body, the radiation shield includes a shield body having an inner opening shaped to permit insertion of the oxidized lead, and an inner lid shaped to close the inner opening and being detachably attachable to the shield body, and the inner opening is formed in the region of the shield body that overlaps at least a portion of the outer opening when viewed in a direction from the outer opening to the oxidized lead.

2. The superconducting magnet device according to claim 1, further comprising:

a fixed table that is provided in the radiation shield to fix the oxidized lead; and a fastener that is detachably fastenable to the fixed table and configured to fasten the oxidized lead to the fixed table, wherein the fastener includes a manipulate-portion that is manipulated using a tool that is insertable through the outer opening and the inner opening, and the fastener is fastenable to the fixed table with the manipulate-portion facing the outer opening and the inner opening.

* * * * *